US007344301B2

(12) United States Patent
Garcia et al.

(10) Patent No.: US 7,344,301 B2
(45) Date of Patent: Mar. 18, 2008

(54) METHOD AND ARRANGEMENT OF ROTATING MAGNETICALLY INDUCIBLE PARTICLES

(75) Inventors: Antonio A. Garcia, Chandler, AZ (US); Anil K. Vuppu, Phoenix, AZ (US)

(73) Assignee: Arizona Board of Regents, Tempe, AZ (US)

( * ) Notice: Subject to any disclaimer, the term of this patent is extended or adjusted under 35 U.S.C. 154(b) by 159 days.

(21) Appl. No.: 11/011,521

(22) Filed: Dec. 14, 2004

(65) Prior Publication Data

US 2005/0286342 A1 Dec. 29, 2005

Related U.S. Application Data

(63) Continuation of application No. PCT/US03/19257, filed on Jun. 20, 2003.

(60) Provisional application No. 60/391,073, filed on Jun. 20, 2002.

(51) Int. Cl.
*B01F 13/08* (2006.01)

(52) U.S. Cl. ..... 366/273

(58) Field of Classification Search ..... 366/273, 366/274

See application file for complete search history.

(56) References Cited

U.S. PATENT DOCUMENTS 2,614,064 A * 10/1952 Carney ..... 208/339
2,735,232 A 2/1956 Simjian
2,932,493 A 4/1960 Jacobs
3,219,318 A * 11/1965 Hershler ..... 366/273
3,848,363 A 11/1974 Lovness et al.
3,869,251 A * 3/1975 Tsantker et al. ..... 422/225
4,310,253 A * 1/1982 Sada et al. ..... 366/273
4,390,283 A * 6/1983 Meyer ..... 366/142
4,568,195 A * 2/1986 Herz et al. ..... 366/274
4,752,138 A * 6/1988 Rufer ..... 366/274
4,936,687 A * 6/1990 Lilja et al. ..... 366/143
5,352,036 A * 10/1994 Haber et al. ..... 366/130
5,468,616 A 11/1995 Coulter et al.
6,517,231 B1 * 2/2003 Biardeau et al. ..... 366/273
2001/0007312 A1 7/2001 Siddiqi

* cited by examiner

*Primary Examiner*—Tony G Soohoo
(74) *Attorney, Agent, or Firm*—McDonnell Boehnen Hulbert & Berghoff LLP

(57) ABSTRACT

This invention provides a device and method for rotating magnetically inducible particles suspended in a fluid by rotating a multidirectional magnetic field through the suspended particles. A rare earth magnet is positioned adjacent to the suspended particles and oriented such that the axis of a magnetic field generated by the magnet passes through the suspension. The magnetic flux lines of the magnet's field radiate in multiple directions through the suspended particles, them to form long multidirectional chains. The magnet and the chains of suspended particles are rotated with respect to one another, the axis of the rotation being approximately parallel to the magnetic axis of the multidirectional magnetic field. This causes the particle chains to rotate about the magnetic axis, thus mixing the fluid.

12 Claims, 6 Drawing Sheets

METHOD AND ARRANGEMENT OF ROTATING MAGNETICALLY INDUCIBLE PARTICLES

RELATED APPLICATION

This application is a continuation application and claims priority to International Patent Application No. PCT/US2003/019257, filed Jun. 20, 2003, and published in English as Publication No. WO 2004/000446 on Dec. 31, 2003, and further claims priority to U.S. Provisional Application No. 60/391,073, which was filed on Jun. 20, 2002, both of which are incorporated by reference in their entireties herein.

FIELD OF THE INVENTION

This invention relates to methods and arrangements for rotating magnetically inducible particles suspended in a fluid. More particularly, the present invention relates to a method and arrangement for mixing fluids containing such particles by subjecting the particles to a rotating, multidirectional, magnetic field.

BACKGROUND OF THE INVENTION

Where the delicate and noninvasive mixing of small-sized fluid samples may be called for, one known technique is to use a rotating magnetic field to mix the fluid. Typically, magnetically inducible particles, such as paramagnetic microspheres, are suspended in the fluid to be mixed. The resulting particle suspension is then placed in a close proximity to a magnetic field such that the flux lines of the magnetic field pass through the suspension in one direction, and substantially in parallel.

FIG. 1 shows a diagram depicting a conventional coil arrangement that mixes the suspended magnetically inducible particles by rotating them using a unidirectional magnetic field. The unidirectional magnetic field is generated electromagnetically using a set of Helmholtz coils 201*a*, 201*b*. Each Helmholtz coil set 201*a*, 201*b* consists of two wound coils 201*a*, 201*b* wired in series, and arranged along a common coil axis. When electrical power is applied to the coils 201*a*, 201*b*, a uniform, unidirectional magnetic field is produced. The strength of this magnetic field is proportional to the number of turns that are present in the coils 201*a*, 201*b*, the applied electric current, the physical size of the coils, and the spacing between the coils. Suspended magnetically inducible particles 204 positioned between and along the common axis of coils 201*a*, 201*b* experience the uniform and unidirectional magnetic field.

FIG. 2 depicts suspended magnetically inducible particles that are subjected to a unidirectional magnetic field, such as the one generated by the conventional device shown in FIG. 1. As may be seen in FIG. 2, the suspended magnetically inducible particles tend to align themselves along the unidirectional magnetic field lines. As a result, long chains of particles 401 are formed, aligned in parallel and in the same direction through a particle suspension area 204.

To rotate these particle chains 401, at least one additional set of coils 203*a*, 203*b* is typically positioned such that its common coil axis is provided at a 90-degree angle from the common axis of the first set of coils 201*a*, 201*b*, as shown in FIG. 1. A 90-degree out-of-phase sinusoidal variation in power is then applied to each set of coils 201*a*, 201*b* and 203*a*, 203*b*, which produces a proportional variation in the strength of the magnetic fields $H_{201}$ and $H_{203}$ generated by coil sets 201*a*, 201*b* and 203*a*, 203*b* respectively. The particle chains 401 tend to align and realign themselves along the strongest lines of the magnetic flux. Varying the strength of the magnetic fields $H_{201}$ and $H_{203}$ produced by coil sets 201*a*, 201*b* and 203*a*, 203*b* respectively as described above, causes the unidirectional particle chains 401 to rotate substantially about their respective centers, thereby mixing the particle suspension area 204.

There are certain disadvantages to magnetic mixing devices that employ the above-described Helmholtz coil arrangement. One such disadvantage is the relative complexity of such devices, since the proper operation of the Hehnholtz coils requires the use of function generators, power amplifiers and cooling systems, among other things. Another disadvantage is that the mixing effect in the conventional Helmholtz coil-based system is substantially limited to the immediate area spanned by the rotating particle chains 401, each of which rotates about its own center. Thus, in order to spread the mixing effect throughout the particle suspension area 204, many particle chains 401 are needed. This makes an inefficient use of the available magnetically inducible particles in the particle suspension area 204.

A second conventional arrangement uses a disc-shaped strong rare-earth magnet in place of Helmholtz coils 201*a*, 201*b* and 203*a*, 203*b*. FIG. 3 shows such a conventional arrangement, which includes a disc-shaped magnet 301 that is mounted edge-wise on a motor shaft 302 that rotates the magnet 301 relative to the particle suspension area 204.

Similarly to the conventional Helmholtz coil-based arrangement described above, the conventional magnet-based mixing arrangement of FIG. 3 applies a unidirectional magnetic field to the suspended magnetically inducible particles in the area 204 contained in the fluid cell 202. Referring to FIG. 3, the edge of the magnet 301 is arranged with respect to the fluid cell 202 such that the magnetic axis 306 of the magnetic field generated by the magnet 301 is perpendicular to an axis of rotation 304 of the magnet 301. The magnetic flux lines produced by the magnet 301 extend approximately in parallel and unidirectionally through the fluid cell 202. The magnetically inducible particles align themselves along the unidirectional magnetic field lines in the long, unidirectional chains 401 (see FIG. 2). As the magnet 301 is rotated about the axis of rotation 304, the magnetic field produced by the magnet 301 also rotates, thus causing the particle chains 401 to rotate around their respective centers to mix the suspension area 204.

However, the described conventional magnet-based arrangement also has certain disadvantages. First, just as with the conventional Helmholtz coil arrangement, the particle chains 401 rotate about their respective centers. Thus, the mixing effect produced by rotation of the magnet 301 is still limited to the immediate area spanned by the rotating, unidirectional chains 401. Second, the farther the area 204 is from the magnetic axis 306 of the magnet 301, the weaker the magnetic field becomes, and the lesser the tendency of the particles to form themselves into chains. Since the mixing effect is a function of the length of each particle chain 401, the mixing effect produced by the rotation of the magnet 301 becomes progressively weaker the farther away the particles are located from the poles of the magnet 301.

SUMMARY OF THE INVENTION

To overcome these and other disadvantages in the prior art, a method and arrangement are provided for mixing a fluid by rotating magnetically inducible particles suspended in the fluid using a multidirectional magnetic field radiated by a magnetic field source such as, for example, a magnet. In an exemplary embodiment of the present invention, a rare earth magnet can be positioned approximately adjacent to an area of suspended magnetically inducible particles, and oriented such that the axis of the magnetic field generated by the magnet passes through such area. The magnetic flux lines of the magnet's field radiate in multiple directions through the particle suspension, thereby causing the magnetically inducible particles to align themselves in long multidirectional chains. The magnet and the suspension are rotated with respect to one another, the axis of the rotation being approximately parallel to the magnetic axis of the multidirectional magnetic field.

The fact that the magnetic field is directed toward the particle suspension, and that the magnetic field is rotated with respect to the particle suspension area, produces a more efficient mixing action. This is because each particle chain is thus able to span a much larger volume of the fluid than was previously possible using the conventional method of rotating unidirectional chains about their own centers. Such increase in the mixing area is especially advantageous for applications in which the suspension areas being mixed have relatively low magnetically inducible particle concentrations, and in which only a few dispersed particle chains can be formed.

BRIEF DESCRIPTION OF THE DRAWINGS

A more complete understanding of the present invention may be obtained from consideration of the following descriptions, in conjunction with the drawings, of which.

DETAILED DESCRIPTION OF THE INVENTION

Figure 1:
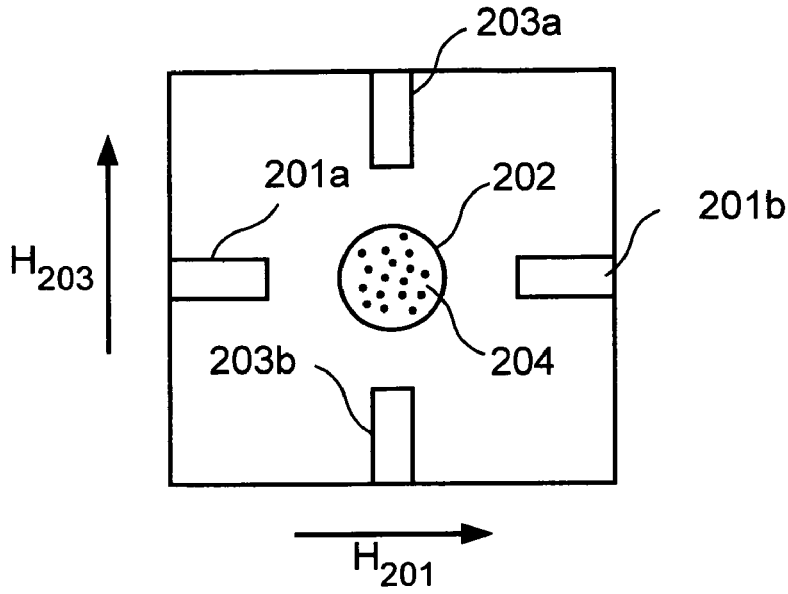
FIG. 1 is a diagram depicting a first conventional arrangement that allows for a rotation of magnetically inducible particles suspended in a fluid using an electromagnetically generated unidirectional magnetic field.
Figure 2:
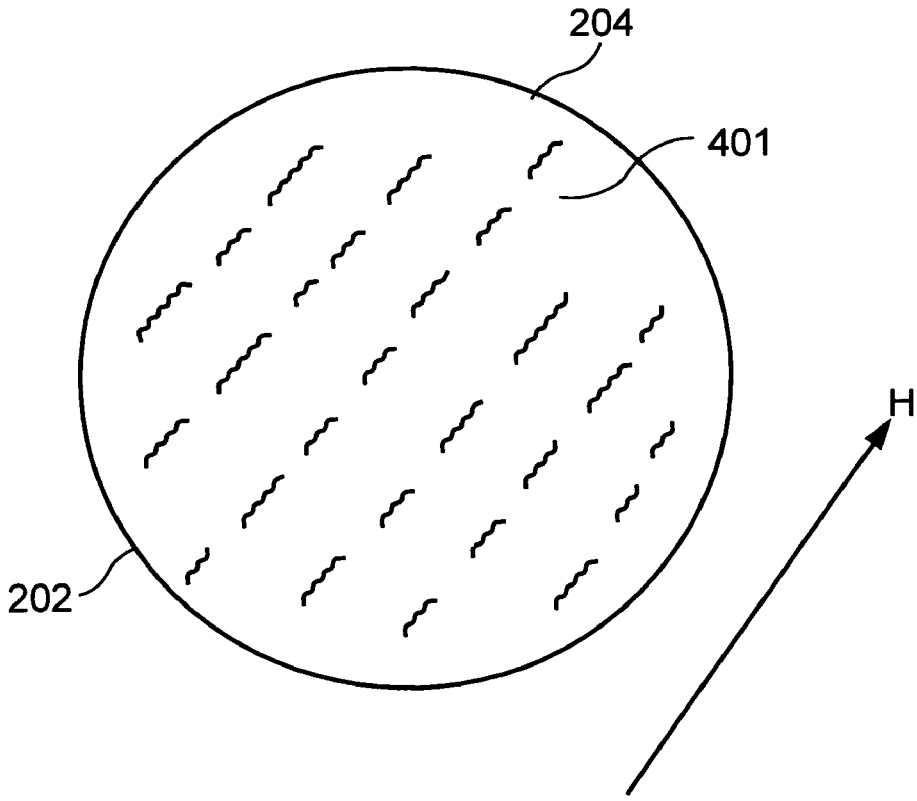
FIG. 2 is a diagram depicting an axial view of paramagnetic particles suspended in a fluid and being exposed to a conventionally generated unidirectional magnetic field of the arrangement shown in FIG. 1.
Figure 3:
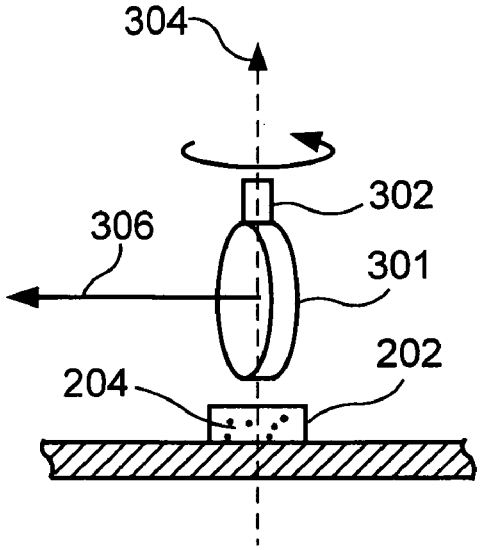
FIG. 3 is a diagram depicting a second conventional arrangement that allows for the rotation of the magnetically inducible particles suspended in the fluid using a unidirectional magnetic field generated by a rare earth magnet.
Figure 4:
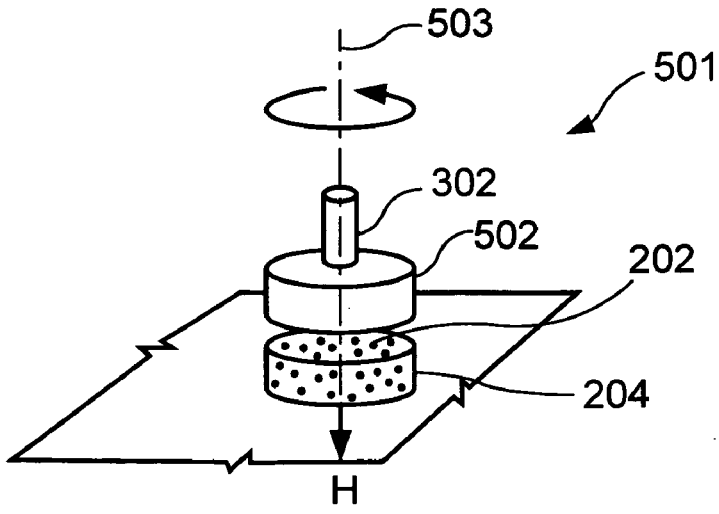
FIG. 4 is a diagram depicting an arrangement that rotates magnetically inducible particles suspended in the fluid using a multidirectional magnetic field in accordance with a first exemplary embodiment of the present invention.

FIG. 4 is a diagram depicting an arrangement that utilizes a multidirectional magnetic field to rotate a fluid suspension comprising magnetically inducible particles in accordance with a first exemplary embodiment of the present invention. This arrangement preferably comprises a drive shaft 302 and a magnet 502 which are configured to operate on a fluid cell 202 and a particle suspension area 204 contained in the fluid cell 202.

The fluid cell 202 may be an open or a closed container that holds the particles in the suspension area 204. The particle suspension area 204 comprises a sample of magnetically inducible particles suspended in the fluid to be mixed. These magnetically inducible particles may include paramagnetic microspheres or any other suitable magnetically inducible particles. The magnet 502 can be a rare earth magnet, such as a neodymium iron boron magnet, but may also be a different type of a magnet or another magnetic field source.

The magnet 502 and the fluid cell 202 can be rotated with respect to one another about an axis of rotation 503. In this first exemplary embodiment of the arrangement, the magnet 502 is rotated, and the fluid cell 202 is maintained in a stationary position. It should be understood that it does not matter whether the magnet 502 or the fluid cell 202 is rotated, or whether both are rotated, as long as relative rotational motion about the axis of rotation 503 is provided between the magnet 502 and the fluid cell 202. A motor (not shown for the sake of clarity), or another suitable driving mechanism preferably drives a motor shaft 302 coupled to the magnet 502, causing the magnet 502 to rotate about the axis of rotation 503. The axis of rotation 503 is preferably, but not necessarily, coincident with the magnetic axis H of the magnetic field produced by the magnet 502.

In the first exemplary embodiment of the arrangement depicted in FIG. 4, the magnet 502 can be shaped in the form of a disc having two flat faces and an edge. At the center of each of the faces of the disc-shaped magnet 502, there may be a magnetic pole. The magnetic axis H of the magnetic field produced by the magnet 502 extends along the straight line connecting the magnet's 502 two magnetic poles, i.e., extends along the magnet's 502 polar axis.

The magnet 502 can be positioned adjacent to the fluid cell 202, with one of its faces facing the particle suspension area 204. In this position, the magnetic axis H of the field can pass through the approximate center of the particle suspension area 204. The magnet 502 may be positioned to be on top of the fluid cell 202, as is depicted in FIG. 4, or alternatively to be below the fluid cell 202, or even to either side of the fluid cell 202. In particular, the magnetic axis H of the magnet's 502 magnetic field should preferably pass through the particle suspension area 204.

Figure 5:
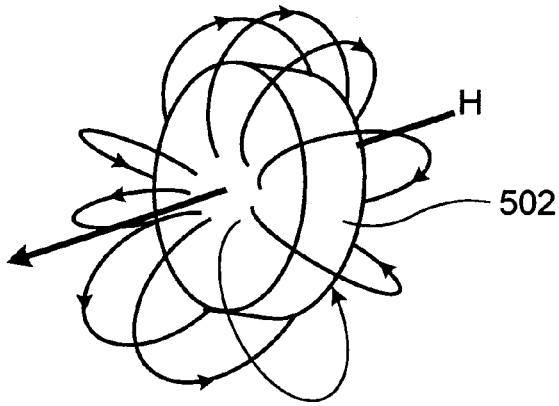
FIG. 5 is a diagram depicting a multidirectional magnetic field H produced by a disc-shaped magnet of the arrangement of FIG. 4 in accordance with the first exemplary embodiment of the present invention.

FIG. 5 is a diagram depicting an exemplary magnetic field produced by the disc-shaped magnet 502 of the arrangement of FIG. 4. It should be understood that the actual vectors and magnitudes of the flux lines at various locations of the magnetic field may depend on a number of factors, including the magnet's 502 geometry and magnetic density as well as the magnetic susceptibility of the surrounding environment.

As may be seen in FIG. 5, the flux lines of the magnetic field can radiate in multiple directions from one magnetic pole on one face of the magnet 502 to the other pole on the opposite face thereof. In planes that are approximately perpendicular to the polar axis of the magnet 502 (i.e., approximately parallel to either face of the disc-shaped magnet 502), the flux lines of the magnetic field likely point in multiple directions, thus radiating in towards, or out from the magnetic axis H of the magnetic field.

Referring back to FIG. 4, the particle suspension area 204 in the fluid cell 202 can be disposed approximately adjacent to the magnet 502 such that the magnetic axis H of the field produced by the magnet 502 can pass through the particle suspension area 204 in a direction that is approximately perpendicular to the plane in which the fluid cell 202 extends. Thus, the arrangement of components depicted in FIG. 4 may cause the particle suspension area 204 to be subjected to a multidirectional magnetic field.

Figure 6:
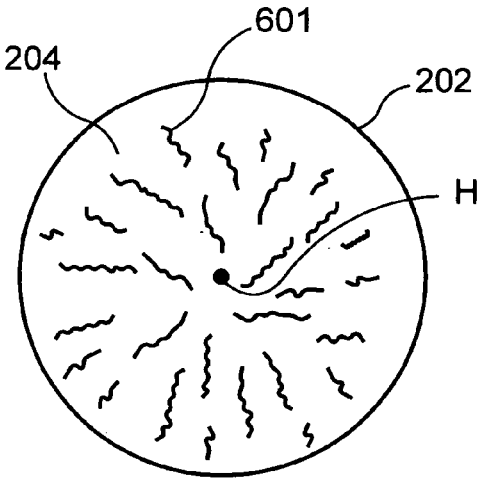
FIG. 6 is a diagram depicting an axial view of the magnetically inducible particles suspended in a fluid and exposed to a unidirectional magnetic field generated by the magnet in accordance with the first exemplary embodiment of the present invention.

FIG. 6 depicts an exemplary magnified axial view of the particle suspension area 204 under the influence of the multidirectional magnetic field generated by the magnet 502 of FIGS. 4 and 5. As shown in FIG. 6, the magnetic axis H of the field is located near the center of the fluid cell 202. While FIG. 6 depicts the magnetic axis H as pointing "out of the page," it should be appreciated by those of skill in the art that the direction of the magnetic axis H is not essential for the present invention. Whether the magnetic field produced by the magnet 501 points "out of the page" as in FIG. 6, or "into the page," the flux lines generally radiate like spokes around the central magnetic axis H, and the magnetically inducible particles in the suspension area 204 can align themselves along the flux lines in long chains 601 that may surround the magnetic axis H.

Figure 8:
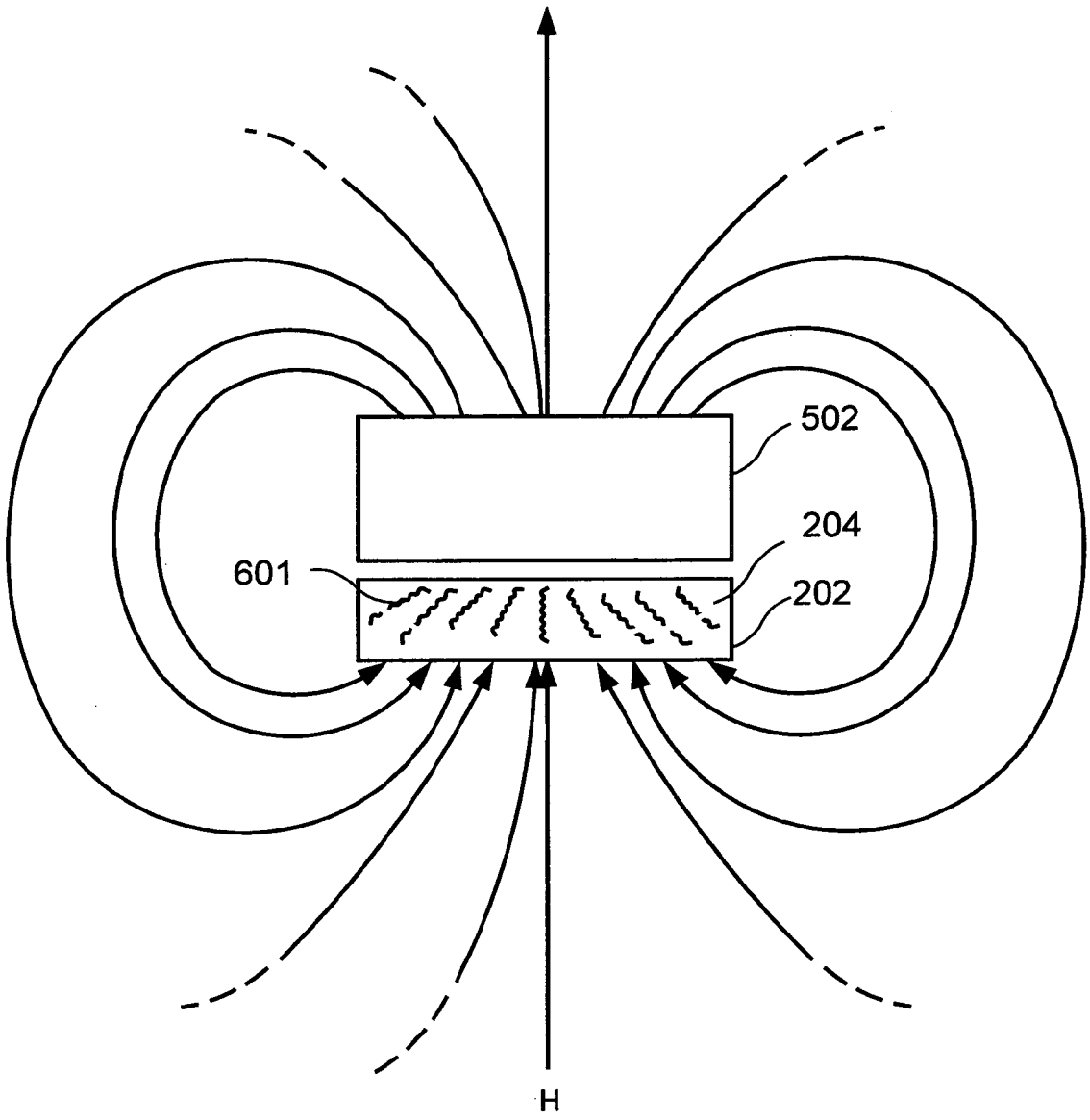
FIG. 8 is a diagram depicting a side view of the arrangement of FIG. 4.

FIG. 8 is a diagram depicting a side view of the arrangement depicted in FIG. 4, showing the approximate vertical orientations of the long chains of particles that are formed under the influence of the multidirectional magnetic field produced by the magnet 502. The flux lines distributed along or near the magnetic axis H of the field can be at very steep angles to the magnetic axis H. At small distances from the magnetic poles of the magnet 502, the flux lines can be nearly parallel to the magnetic axis H.

Thus, the particle chains 601 in the suspension area 204 are oriented at varying angles to the magnetic axis H. Those particle chains 601 that are approximately closest to the nearest pole of the magnet 501 tend to align themselves approximately in parallel to the magnetic axis H. As the distance between the magnetic poles and the magnetically inducible particles increases, the angle between the particle chains 601 and the magnetic axis H becomes less steep. The particle chains 601 that are situated furthest from the magnet's 502 poles can be oriented almost perpendicularly to the magnetic axis H.

Figure 7:
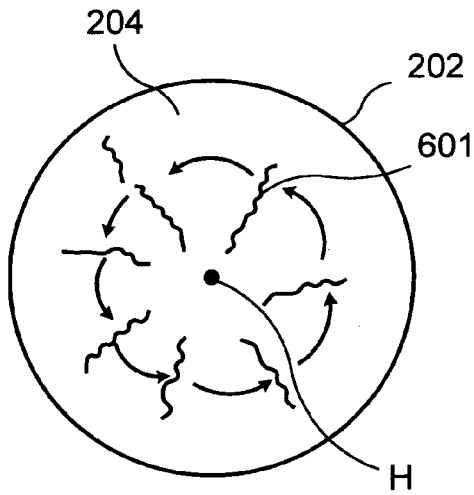
FIG. 7 is a diagram depicting an axial view of the magnetically inducible particles suspended in a fluid and rotated by a rotating multidirectional magnetic field in accordance with the first exemplary embodiment of the present invention.

The multidirectional structure of the particle chains 601 allows each particle chain 601 to possibly span substantially the entire depth of the particle suspension area 204. Thus, the multidirectional particle chains 601 according to the present invention can span a greater volume of the particle suspension area 204 than the unidirectional particle chains formed in accordance with the previously described conventional methods and arrangements. Furthermore, the variation in the angles of the particle chains 601 with respect to the magnetic axis H, as may be seen in FIG. 8, result in a cone-like particle chain structure which, when rotated, may produce a highly efficient three-dimensional mixing effect at possibly every depth of the particle suspension area 204. FIG. 7 is a representation of an exemplary magnified axial view of multidirectional particle chains rotating about the magnetic axis H of the multidirectional magnetic field produced by the magnet 502.

As previously described, the magnet 502 depicted in FIGS. 5 through 8 can preferably be a disc-shaped rare earth magnet. However, it should be understood by those of ordinary skill in the art that magnets having other shapes may also be employed to induce the formation of the multidirectional particle chains in accordance with the present invention. The actual magnetic field produced by the magnet generally can depend on the strength of the magnet 502 and its geometric arrangement.

Figure 9:
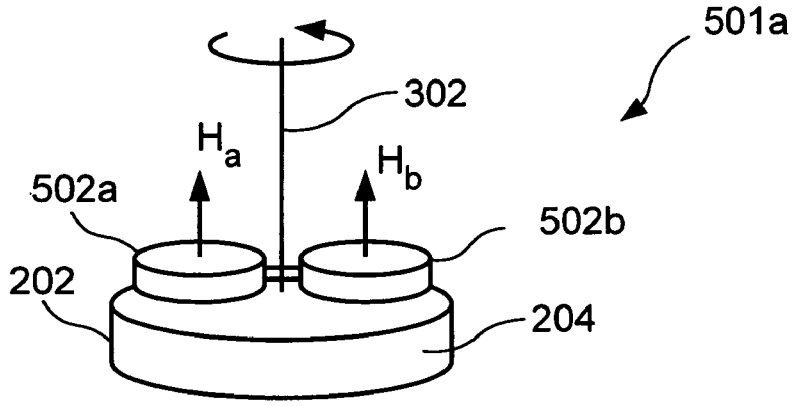
FIG. 9 is a diagram depicting another arrangement that rotates the magnetically inducible particles using the multidirectional magnetic field generated by two magnets in accordance with a second exemplary embodiment of the present invention.

FIG. 9 is a diagram depicting another arrangement 501*a* for rotating the magnetically inducible particles that uses two or more magnets 502*a*, 502*b* in accordance with a second exemplary embodiment of the present invention. The magnetic poles of the magnets 502*a*, 502*b* are aligned in the same direction. This second exemplary arrangement 501*a* functions in approximately the same way as the exemplary arrangement of FIG. 4, except that the magnetic axes Ha, Hb of magnets 502*a*, 502*b* are not coincident with the axis of rotation 302. Rather, the magnetic axes Ha, Hb of the arrangement 501*b* of FIG. 9 extend on opposite sides of the axis of rotation 302.

Figure 10:
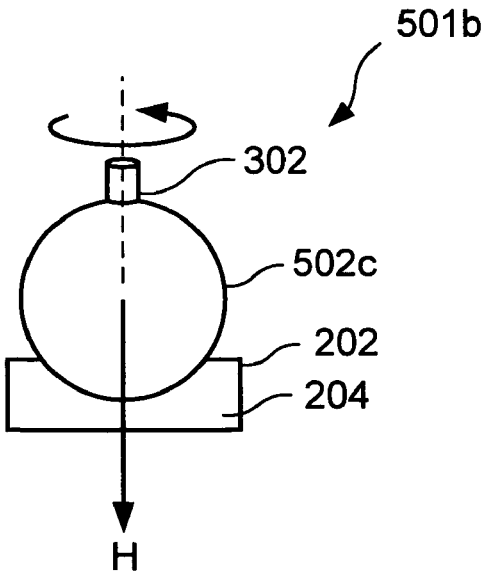
FIG. 10 is a diagram depicting yet another arrangement that rotates the magnetically inducible particles using the multidirectional magnetic field generated by a spherical magnet in accordance with a third exemplary embodiment of the present invention.

FIG. 10 is a diagram of another arrangement 501*b* for rotating the magnetically inducible particles in accordance with a third exemplary embodiment of the present invention, in which a spherical magnet 502*c* is used. The magnetic field lines of the spherical magnet 502*c* typically curve around the magnet's body and radiate at less acute vertical angles relative to the poles of the magnet 502*c*. Similarly to the arrangement shown in FIG. 8, the spherical magnet 502*c* may be disposed proximate to the fluid cell 202. The fluid cell 202 may be positioned at one pole of the magnet 502*c* and can further be formed partially around the magnet 502*c*.

Figure 11:
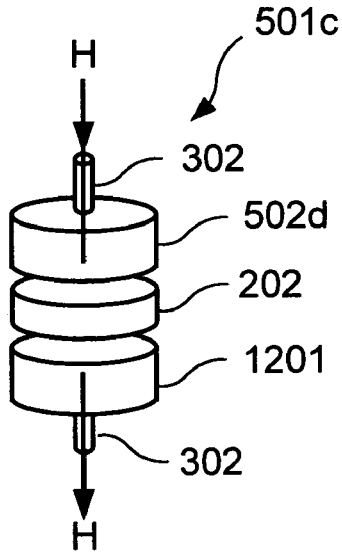
FIG. 11 is a diagram depicting still another arrangement that rotates the magnetically inducible particles using the multidirectional magnetic field generated by two magnets working in tandem in accordance with a fourth exemplary embodiment of the present invention.

FIG. 11 is still another arrangement 501*c* for rotating the magnetically inducible particles according to a fourth exemplary embodiment of the present invention. Arrangement 501*c* utilizes two magnets 502*d* and 1201 working in tandem. Magnets 502*d* and 1201 are coupled to a motor shaft 302 that rotates both magnets 502*d*, 1201 in the same direction. The magnet 1201 is disposed such that the pole of magnet 1201 that is closest to the fluid cell 202 is of a polarity that is opposite to that of the pole of the magnet

502*d* that is closest to the fluid cell 202. Accordingly, the flux lines of the magnetic fields produced between the magnets 502*d*, 1201 may be brought into a closer alignment with each other rather than diverging from each pole. Thus, a particle suspension area 204 placed in a fluid cell 202 between the two magnets 502*d*, 1201, may be subjected to a greater density of magnetic flux lines.

Figure 12:
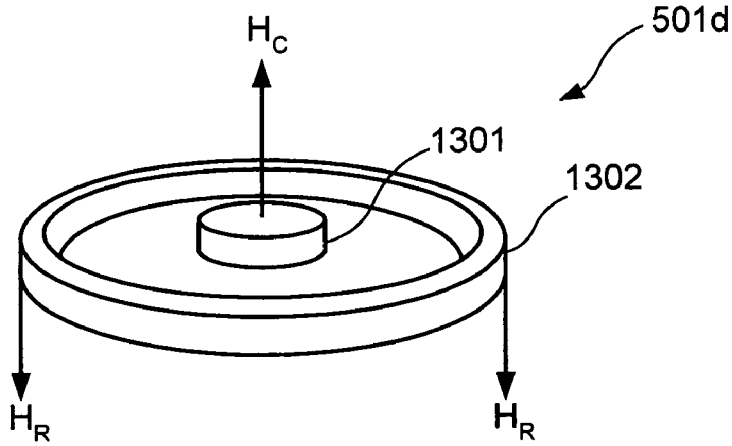
FIG. 12 is a diagram depicting a further arrangement that rotates the magnetically inducible particles using the multidirectional magnetic field generated by a core magnet and a ring magnet operating in tandem, in accordance with a fifth exemplary embodiment of the present invention.

FIG. 12 is a diagram of yet another arrangement 501*d* for rotating magnetically inducible particles in accordance with a fifth exemplary embodiment of the present invention. This arrangement 501*d* includes a core magnet 1301 and a ring magnet 1302 operating in tandem. These two magnets 1301, 1302 are arranged so as to allow for field lines that are at smaller vertical angles, and that permeate the particle suspension area 204 in a more uniform manner along a specific plane. Accordingly, the core magnet 1301 can be disposed at approximately the center of the ring magnet 1301. The core magnet 1301 may be arranged with the ring magnet 1302 such that the magnetic field $H_C$ of the core magnet 1301 and the magnetic field $H_R$ of the ring magnet 1302 are oppositely aligned and approximately parallel to each other. Accordingly, the magnetic flux lines radiate from one pole of the core magnet 1301 to a proximate and oppositely magnetized pole of the ring magnet 1302. A fluid cell (not shown for the sake of simplicity) may be provided between the two magnets 1301, 1302 and such fluid cell may be disposed at one side of the magnets 1301, 1302. The magnets 1301, 1302 may then be rotated in tandem about the magnetic axis of the core magnet 1301 in order to cause the induced particle chains to rotate. It should be appreciated by those of ordinary skill in the art that the arrangement of the magnets 1301, 1302 and their distance from the fluid's surface can be used to determine the strength and the orientation of the magnetic field passing through the fluid.

Figure 13:
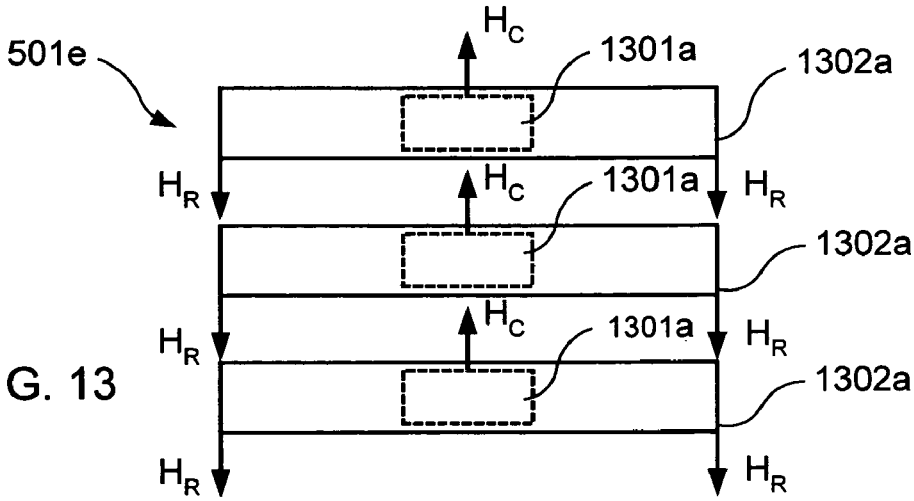
FIG. 13 is a diagram depicting another arrangement that rotates the magnetically inducible particles using the multidirectional magnetic field generated by multiple core magnets and multiple ring magnets operating in tandem, in accordance with a sixth exemplary embodiment of the present invention.

FIG. 13 is a diagram of a side view of a further arrangement 501*e* in accordance with a sixth exemplary embodiment of the present invention, that rotates magnetically inducible particles in a way that is approximately similar to the arrangement 501*d* shown in FIG. 12. A stack of core magnets 1301*a* of the arrangement 501*e* may be provided at approximately the axial center of a stack of ring magnets 1302*a* and can be spaced from or positioned close to one other. The length of the stack of the ring magnets 1302*a* may be approximately equal to a length of the stack of the core magnets 1301*a*. The core magnets 1301*a* in the stack are provided having their magnetic fields $H_C$ oriented parallel but opposite to the fields $H_R$ of the ring magnets 1302*b*. In addition, the stack of the core magnets 1301*a* may be a cylindrical bar magnet (not shown for the sake of simplicity) and the stack of the ring magnets 1302*a* may be a tube magnet (not shown for the sake of simplicity).

Figure 14:
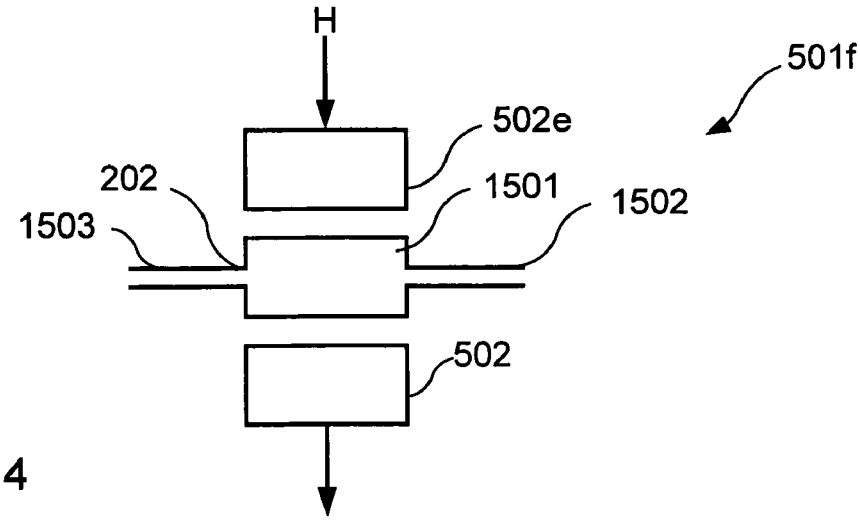
FIG. 14 is a diagram depicting a mixing chamber that can be used in conjunction with the arrangements of FIGS. 4 through 13, in accordance with a seventh exemplary embodiment of the present invention.

FIG. 14 is a diagram depicting a mixing chamber 1501 of another arrangement 501*f* in accordance with a seventh exemplary embodiment of the present invention. The mixing chamber 1501 is provided as the fluid cell 202 with one fluid inlet 1502 and one fluid outlet 1503. The mixing chamber 1501 may contain the particle suspension 204, in which the particle chains can be formed in alignment with the multi-directional magnetic field H. The magnet 502*e* may be either on the top or at the bottom of the chamber, or two magnets 502*e*, 502*f* may be used: one on top and one on the bottom. The particle suspension area 204 can be pumped into the mixing chamber 1501 through the fluid inlet 1502, and may remain in the mixing chamber 1501 until appropriately mixed by the rotating magnetic field H. Thereafter, the particle suspension area 204 can flow out from the fluid outlet 1503. It should be appreciated by those of ordinary skill in the art that the mixing chamber 1501 may be optimized to minimize the amount of time the fluid stays in the mixing chamber 1501, and to minimize the mixing time.

The invention has been described in connection with certain preferred embodiments. It will be appreciated that those skilled in the art can modify such embodiments without departing from the scope and spirit of the invention that is set forth in the appended claims. Accordingly, these descriptions are to be construed as illustrative only and are for the purpose of enabling those skilled in the art with the knowledge needed for carrying out the best mode of the invention. The exclusive use of all modifications and equivalents are reserved as covered by the present description and are understood to be within the scope of the appended claims.

What is claimed is:

1. A method for mixing a fluid that includes magnetically inducible particles, the method comprising:

orienting magnetic field sources such that the lines of magnetic flux produced by the magnetic field sources radiate simultaneously in multiple directions through the fluid, wherein the magnetic field sources comprise a first magnetic field source and a second magnetic field source, the first magnetic field source being a ring-shaped source, and the second magnetic field source being a core source;

disposing the core source at an approximate center of the ring-shaped source;

aligning the magnetic field of the core source along a direction that is opposite and approximately parallel to a direction of the magnetic field of the ring-shaped source;

positioning the fluid between the core source and the ring-shaped source; and rotating the core source and the ring-shaped source in tandem about a magnetic field axis of the core source.

2. The method of claim 1, wherein the ring-shaped source comprises two or more ring-shaped magnets.

3. The method of claim 1, wherein the core source comprises two or more disc-shaped magnets.

4. The method of claim 1, wherein the core source is a cylindrical bar magnet, and the ring-shaped source is a tube magnet.

5. The method of claim 1, wherein the magnetically inducible particles form chains aligned along the lines of flux.

6. The method of claim 5, wherein the magnetic field source further comprises a mechanism that rotates the core source and the ring-shaped source in tandem about a magnetic field axis of the first magnetic field produced by the core source, such that the axis of the rotation is approximately parallel to the magnetic axes of the first and second magnetic fields, and wherein the rotation causes the chains of magnetically inducible particles to rotate in the fluid.

7. A device for mixing a fluid comprising magnetically inducible particles, comprising: a ring-shaped magnetic field source capable of producing a first magnetic field; and a core magnetic field source located at the approximate center of the ring-shaped source and capable of producing a second magnetic field, the second magnetic field being aligned along a direction that is opposite and approximately parallel to the first magnetic field, wherein the fluid can be located between the core source and the ring-shaped source such that magnetic lines of flux produced by the core source and the ring-shaped source are capable of simultaneously radiating in multiple directions through the fluid.

8. The device of claim 7, wherein the magnetically inducible particles are capable of forming chains aligned along the lines of flux.

9. The device of claim 8, further comprising a mechanism that rotates the core source and the ring-shaped source in tandem about a magnetic field axis of the first magnetic field produced by the core source, such that the axis of the rotation is approximately parallel to the magnetic axes of the first and second magnetic fields, and wherein the rotation is capable of causing the chains of magnetically inducible particles to rotate in the fluid.

10. The device according to claim 9, wherein the ring-shaped source comprises two or more ring-shaped magnets.

11. The device according to claim 9, wherein the core source comprises two or more disc-shaped magnets.

12. The device according to claim 9, wherein the core source is a cylindrical bar magnet and the ring-shaped source is a tube magnet.

* * * * *